US006142843A

United States Patent [19]

Haase

[11] Patent Number: 6,142,843

[45] Date of Patent: Nov. 7, 2000

[54] SWIMMING AND/OR GYMNASTICS SYSTEM

[75] Inventor: Otto Haase, Salzgitter, Germany

[73] Assignee: iBrigette Haase, Salzgitter, United Kingdom

[21] Appl. No.: 09/269,928

[22] PCT Filed: Aug. 5, 1998

[86] PCT No.: PCT/EP98/04886

§ 371 Date: Jun. 7, 1999

§ 102(e) Date: Jun. 7, 1999

[87] PCT Pub. No.: WO99/07444

PCT Pub. Date: Feb. 18, 1999

[30] Foreign Application Priority Data

Aug. 5, 1997 [DE] Germany ..... 197 33 805

[51] Int. Cl.[7] ..... B63C 9/08

[52] U.S. Cl. ..... 441/129; 482/111

[58] Field of Search ..... 441/35, 37, 55, 441/65, 74, 75, 129; 482/55, 111

[56] References Cited

U.S. PATENT DOCUMENTS

| | | | |
|---|---|---|---|
| 3,517,930 | 6/1970 | Jacobsen | 482/55 |
| 5,106,109 | 4/1992 | Tattersall et al. | 441/65 |
| 5,266,069 | 11/1993 | Thorne | 482/111 |
| 5,643,154 | 7/1997 | Awbrey | 482/111 |
| 5,833,505 | 11/1998 | Huang | 441/129 |

FOREIGN PATENT DOCUMENTS 593763 2/1934 Germany .

*Primary Examiner*—Stephen Avila
*Attorney, Agent, or Firm*—Salter & Michaelson

[57] ABSTRACT

The invention relates to a swimming and/or gymnastics system comprising a flat base element with openings and with added elements which can be connected to said base element by insertion. Said added elements are an added element which creates resistance to water and which is shaped in such a way that it can engage in at least one central opening of the base element and which encompasses the base element tightly around the edges, and a grip element which engages in the longitudinal openings of the base element.

19 Claims, 6 Drawing Sheets

SWIMMING AND/OR GYMNASTICS SYSTEM

TECHNICAL FIELD

The invention relates to a swimming and/or gymnastics system, which comprises a flat basic element with openings and further additional elements connectable to said openings by insertion.

BACKGROUND OF RELATED ART

Swimming boards and swimming aids are known, e.g. from DE-PS 593 763, DE 43 33 941 A1, DE-GM 1 770 532 as well as the prospectus of the company, Volley Sportartikel GmbH, Ispo 1989, pages 18 to 20. DE-PS 593 763 discloses an auxiliary device for teaching oneself to swim, wherein a shaped board comprises, at the rear end, a semicircular recess for supporting the chin of the swimmer as well as, on its top surface, at least two handles which are provided at arm's length distance in forward direction on the top surface of the board.

DE-GM 17 70 532 discloses a swimming board, which comprises a substantial body having at least two handles and a cutout for the head or chin of the swimmer. The swimming board is used as a simple aid for learning to swim, for lifesaving as well as an aid for rescuing shipwrecked persons.

DE 43 33 341 A1 discloses a swimming aid comprising buoyancy elements, which in numerous variants are connected to a carrier element. The swimming aid is fastened by a belt to the waist region of the swimmer.

Said previously known swimming boards, aids for learning to swim and rescue aids are usable only for their, in each case, very narrowly defined intended application.

Swimming systems are likewise known, particularly in the form of a two-part training aid for swimmers, which comprises a flat basic element and a resistance element insertable vertically into the latter.

The flat basic element is substantially rectangular with a trapezoidal moulding provided in the top region. The corners are in each case rounded-off. In the upper trapezoidal projection, an elongate rectangular slot is provided. In the lower region of the flat basic element, round openings are provided at a distance from the outside edge of the basic element. On the one hand, feet may be inserted through said round openings. On the other hand, however, the front portions of the hand may engage therein, with the balls of the thumbs being held firmly against the outside edge of the flat basic element. The flat resistance element has a middle region, which fits exactly into the elongate rectangular slot of the flat basic element. Outside of said middle region, the resistance element protrudes at the one side. In so doing, it forms a substantially rectangular region with rounded corners and two round openings arranged symmetrically relative to one another in the surface of said region. The other sub-region of the resistance element adjacent to the region engaging into the flat slot is provided in an inward direction with recesses, the dimensions of which are such that there is room inside for the ankles. The recess is delimited at the outer side of the resistance element by elongate end regions projecting in a hammer-like manner and describing a curve with a flat edge. The resistance element when inserted into the slot inside the basic element creates a water resistance, wherein said resistance element on account of the water flowing against it may execute a tilting motion inside the rectangular slot.

Such swimming systems, while being already somewhat more versatile than the swimming aids initially discussed at the start, are however still usable only in a very restricted and limited manner.

The object of the invention is to provide a swimming and/or gymnastics system according to the preamble of claim 1, which may be grasped and held fast very well by the hands, involves only a low expenditure of material and is usable in an extremely versatile manner for swimming exercises and gymnastics exercises in water but also on land.

SUMMARY

Said object is achieved by a swimming and/or gymnastics system according to the preamble of claim 1 in that additional elements are a water resistance-creating element, which is shaped so as to be engageable into at least one central opening of the basic element and embraces the basic element in a clamping manner at the latter's outside edges, and a gripping element which engages into elongate openings of the basic element. Developments of the invention are defined in the sub-claims.

The result is a swimming and gymnastics system, by means of which numerous water gymnastics exercises may be carried out by one person and also by a plurality of persons. It is in particular also suitable for swimming exercises both in the prone position and in the supine position. During swimming exercises in the supine position, the back of the swimmer is very advantageously stretched, which may be checked very easily e.g. by the swimming coach.

The swimming boards of prior art are ill-suited for swimming exercises in the supine position because it is only with great difficulty that the hands may engage from below into said swimming boards. A good grip on the swimming boards in the supine position is therefore possible only with great difficulty because the swimming boards generally demonstrate a tendency to slip out of the grasp of the hands. This is caused in particular by the fact that, if the swimming boards of prior art do have openings at all, said openings are at such a distance from the outside edges of the swimming boards that the gripping hands rest with the knuckles against the edges of the openings. Given prolonged training, this may lead to painful chafing. It is precisely this which is advantageously avoided with the boards according to the invention.

For, in the case of the flat basic elements according to the invention, elongate openings are in a particularly preferred manner provided in the region of the outside edges of the basic element. The elongate openings preferably have a curvature corresponding to the hand curvature of the hands engaging therein. The engaging hands are therefore able to get a particularly good grip in said openings.

The water resistance-creating additional element is also advantageously fastened to the flat basic element in such a way that even given a greater water resistance, e.g. in the case of a user swimming at high speed, it may execute only a slight tilting motion relative to the flat basic element of, in particular, a few centimeters in the lowest range, e.g. of at most 3 cm. This is advantageously effected in that said water resistance-generating element has a double attachment to the flat basic element. First, it engages into a central opening of the flat basic element. Said central opening may be disposed at any desired point in the region of the centre line of the basic element, particularly in the middle of said centre line. In a particularly preferred manner, this is effected by a projecting lug in the middle of the additional element. Two straight regions disposed symmetrically to one another are supported against the underside of the flat basic element. The two adjoining elements, which embrace the basic element at the latter's outside edges, are preferably designed in a hook-like manner such that their outer extensions are directed towards the projecting lug, wherein the hook-like outer extensions rest on the top surface of the flat basic element.

In a particularly preferred manner, said additional element is therefore made of an elastically bendable but, at the same time, strong material. Upon mounting of the additional element onto the basic element, first the projecting lug is inserted into the central opening of the flat basic element, then the two hook-like elements are placed around the outside edges of the basic element. Said hook-like elements then clamp the flat basic element between themselves and the projecting lug.

To provide an improved insertability for the hands, in a particularly preferred manner the outside edges in the region of elongate openings of the flat basic element are provided with an inward curve or outward curve in the region of a middle opening or of two openings and with an outward curve in the region of two elongate openings arranged symmetrically to one another at the opposite end to the middle opening or the two similarly or correspondingly arranged openings.

Instead of three elongate openings it is however also possible to provide five or more or only two aligned in a line in the middle, symmetrically relative to the centre line of the substantially elongate flat basic element. A gymnast may then insert his hands into said two openings. The flat basic element may be provided for gymnastic purposes but also for swimming exercises in a round or polygonal, e.g. hexagonal or octagonal, form. The elongate openings in said case are each provided in the region of the outside edge of the basic element.

Instead of said two elongate openings adjacent to the narrow outside edges it is however also possible to provide multiples of two, e.g. four, elongate openings arranged in each case mirror-symmetrically to one another in the region of the longitudinal edges and/or in the region of the corners of the basic element. It is then also possible for two or four persons, for example, to engage into said elongate openings for gymnastic purposes. Preferably, said elongate openings are then provided in the region of the longitudinal sides of an elongate, substantially rectangular flat basic element, which is preferably provided with inward and/or outward curves at the narrow or short sides.

In a particularly preferred manner, the flat basic element as well as the water resistance-generating additional element are composed of layers. In a particularly preferred manner, a high-pressure polyethylene or a high-expansion foam material, e.g. a high-expansion foam material sold under the trademark Plastazote® by the company Zotefoams Ltd., is used as a material.

The board-like gripping element in a particularly preferred manner is manufactured from a harder, resilient, fracture-proof material, e.g. a plastic material. In a particularly preferred manner, its board part has a shape similar to a boomerang and is provided with openings, in particular four drill holes. Handles which engage into said openings are provided. Said handles project with their loops or in the form of cords from the top surface of the board part and are fastened at the underside of the latter. The handles preferably take the form of flexible loops or cords which are at least partially surrounded by resistant tubular sheath elements. By virtue of the resistant sheath elements an improved gripping capacity and a more secure hold in said handles is possible. Wear of the cords is also reduced thereby.

In a particularly preferred manner, a further additional element in the form of a rod-like element is provided. The diameter of said element is so designed and/or the central opening of the basic element is so dimensioned that the rod-like element fits into the central opening. By choosing a suitable material for the rod-like element, the latter is secured in a slip-proof manner inside the opening. By, for example, mounting one basic element onto each end of the rod-like element it is possible to create a system, on which the person exercising may keep a firm hold with his hands or on which he may support his arms. In a particularly advantageous manner, this allows exercises to be carried out in the supine or the prone position.

The possibilities according to the invention result in a swimming and/or gymnastics system which is far superior to the conventional swimming systems. If offers, e.g. a swimming teacher, interesting ways of motivating his pupils by providing a wealth of different options, many different exercises may be carried out with one and the same appliance in ever changing variations and assembled positions and yet only the initial cost of an appliance is required. Besides the low cost, the small amount of storage space taken up by said swimming systems should also be mentioned. If one wished with various appliances from prior art to carry out the same or at least some of the movement exercises possible with the appliance according to the invention, this would involve a large number of appliances and a correspondingly high spatial requirement. In the case of transportation e.g. on ships, the correspondingly reduced weight requirement is also a factor.

The appliances from prior art are predominantly intended either for learning to swim, in the simplest form, or however also for rescuing drowning and shipwrecked persons. Despite the simple and, for the user, easily comprehensible assembly options of the appliances according to the invention, said appliances have a far wider range of application.

BRIEF DESCRIPTION OF THE DRAWINGS

For a more detailed explanation of the invention, there now follows a detailed description of embodiments with reference to the drawings. Said drawings show in.

DETAILED DESCRIPTION OF THE ILLUSTRATIVE EMBODIMENT

Figure 1:
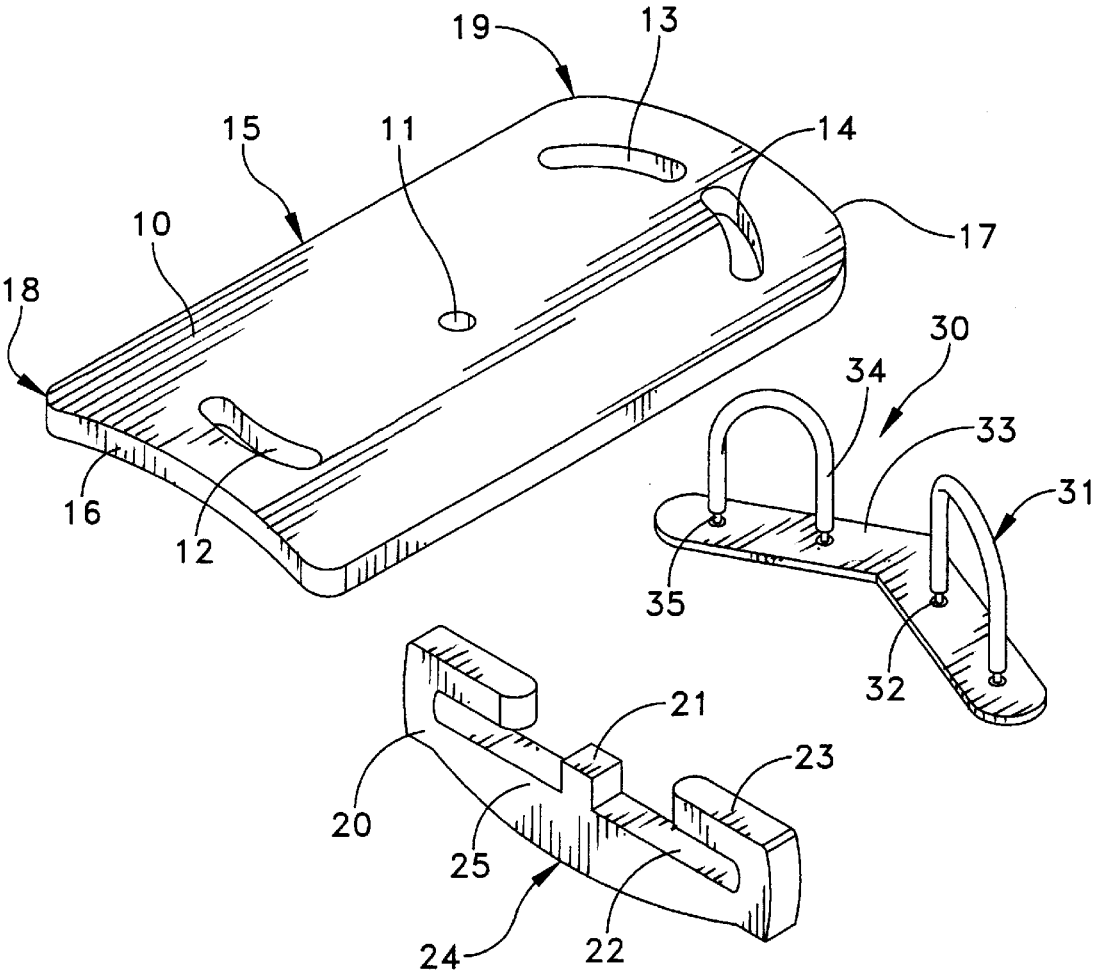
FIG. 1 a perspective view of a flat basic element according to the invention with additional elements, FIG. 2 a perspective view of a second embodiment of the flat basic element, FIG. 3 a third embodiment of a flat basic element, FIG. 4 a fourth embodiment of a flat basic element according to the invention, FIG. 5 a fifth embodiment of a flat basic element according to the invention, FIG. 6 a sixth embodiment of a flat basic element, FIG. 7 a seventh embodiment of a flat basic element, FIG. 8 an eighth embodiment of a flat basic element, FIG. 9 a perspective view of a system comprising two basic elements with a rod-like additional element, FIG. 10 a side view of an embodiment of a rod-like additional element, FIG. 11 a perspective view of a second embodiment of a gripping element according to the invention, FIG. 12 a perspective view of basic element and gripping element, and FIG. 13 a perspective view of the flat basic element according to FIG. 1 with additional elements attached thereto by way of example.

FIG. 1 shows a perspective view of a flat basic element 10, and of a water resistance-generating additional element 20 and a board-like gripping element 30 as additional elements associated with the basic element. The flat basic element is substantially rectangular. It has a central opening 11. The two longitudinal edges 15 are formed substantially parallel to one another. The two outside edges 16, 17 disposed transversely relative to said longitudinal edges form, in the one case, an inward curve and, in the other case, an outward curve. In the region of the outside edge 16 with the inward curve, a middle elongate opening 12 is provided. The middle elongate opening 12 has a curvature, which is curved in the opposite direction to the inward curve of the outside edge 16. In the region of the outside edge 17 with the outward curve, two further elongate openings 13, 14 are provided. The latter are provided with a curvature which follows the curvature of the outward curve. It is therefore possible to get a particularly secure grip in the openings 12, 13, 14.

The four outer corners 18, 19 are rounded in shape. The two corners 18 at the outside edge 16 with the inward curve in said case have a smaller radius than the corners 19 at the outside edge 17 with the outward curve.

FIG. 1 also shows in a perspective view two additional elements for the flat basic element 10. The one additional element is in said case the water resistance-generating additional element 20. The latter is substantially flat. At its one end it has a centrally disposed projecting lug 21. Provided on the left and right of said centrally disposed projecting lug 21 are straight regions 22. Adjoining said two straight regions 22 on either side are hook-like clamping elements 23. The outer extensions of the latter project in the direction of the projecting lug 21. At the opposite end to the projecting lug 21 and the straight regions 22, the additional element 20 has a curved end 24. The curve of the latter extends between and up to the two hook-like clamping elements 23. The surface between the straight regions 22 and the curved end 24 of the additional element 20 may in said case generate a water resistance.

Figure 11:
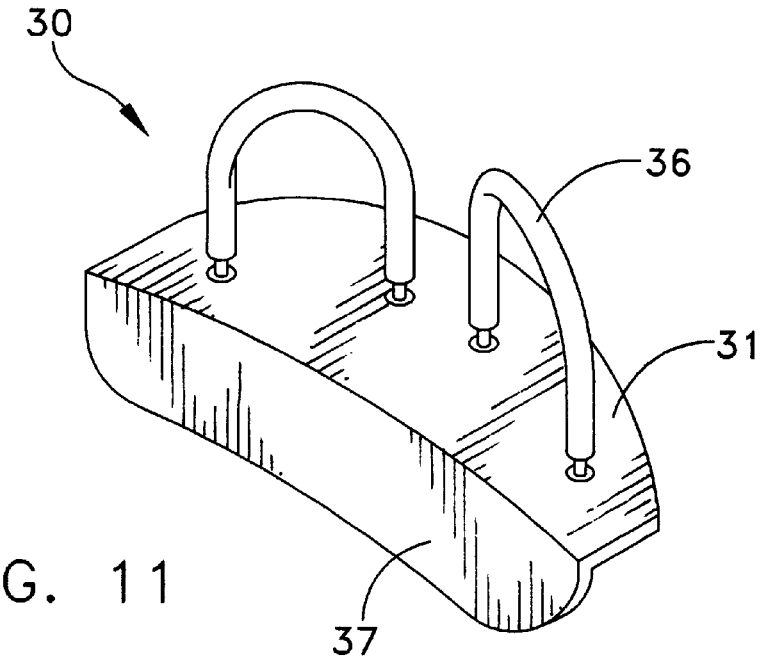

The water resistance-generating additional element 20 is fastened to the flat basic element 10 such that the projecting lug 21 engages into the central opening 11 of the basic element and the two hook-like clamping elements 23 embrace the flat basic element and clamp the latter firmly between themselves and the straight regions 22 of the additional element 20. A corresponding flat basic element 10 with attached water resistance-generating additional element 20 is illustrated in FIG. 11.

FIG. 1 further shows in a perspective view a board-like gripping element 30 as a further additional element associated with the flat basic element. The board-like gripping element has two handles, which are passed through openings 32 of a board part 33 and fastened at the underside of the latter. The handles 31 may, for example, take the form of loops 35 enclosed by sheath elements 34. The sheath elements 34 are, for example, tubular portions which are put on over the loops 35. By said means the loops, which are otherwise not particularly strong, are stabilized in terms of their shaping and therefore easier to grasp. They are moreover protected against premature wear. A fastening of the loops 35 at the underside of the board part 33 is effected, for example, by knotting via washers to prevent their sliding out through the openings 32.

Instead of loops 35 with sheath elements 34 it is however also possible to provide prefabricated handles 31 made of other materials. The board part 33 namely is preferably made of a relatively hard but at the same time resilient and fracture-proof material, in particular a plastic material. The sheath elements, for example, are made likewise from a tubular plastic material, which covers the loops 35 formed from fibres.

In a particularly preferred manner, the flat basic element 10 and the additional element 20 are made of high-pressure polyethylene or another high-expansion foam material, particularly in the form of superimposed foam material layers. It is therefore possible, for example, for the layers also to exhibit different properties, in particular elasticity in the middle and hardness at the outer surfaces.

Figure 2:
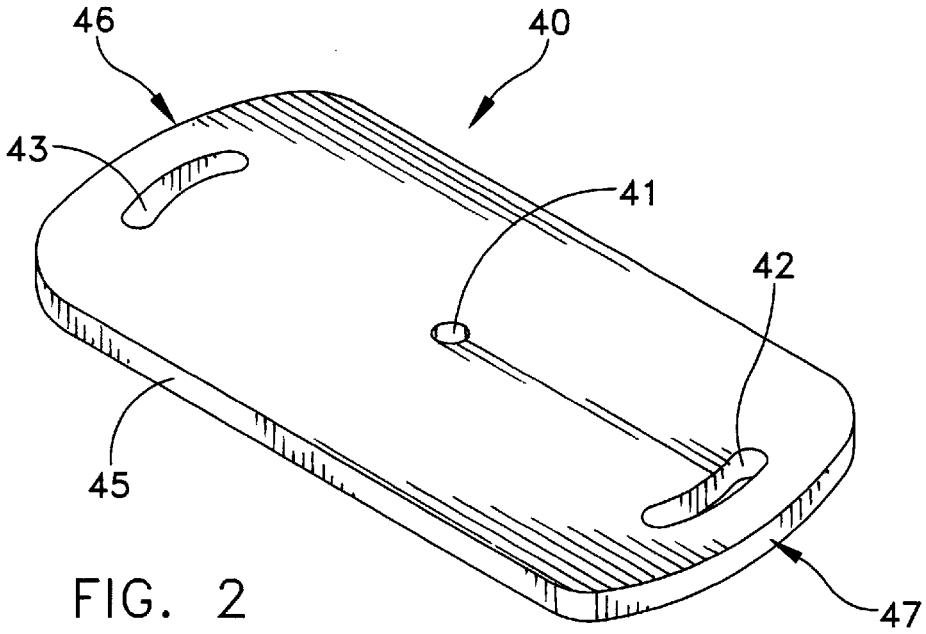

FIG. 2 shows a perspective view of a second embodiment of a basic element 10 according to the invention. Said basic element, like the flat basic element 10 according to FIG. 1, has a central opening 41. However, unlike the flat basic element according to FIG. 1, the outside edges 46, 47 disposed between the longitudinal edges 45 are provided with outward curves. In the region of said outside edges 46, 47 elongate openings 42, 43 are provided, in each case in the middle. The latter are formed mirror-symmetrically relative to the centre line of the basic element. The elongate openings are provided in each case with a curvature which follows the respective outward curve of the two outside edges 46, 47.

Such a basic element 10 according to FIG. 2 lends itself extremely well to water gymnastics exercises because it is possible to insert both hands into the two openings 42, 43, hold the flat basic element in front of the body and, for example, swing it to the left and right.

Figure 3:
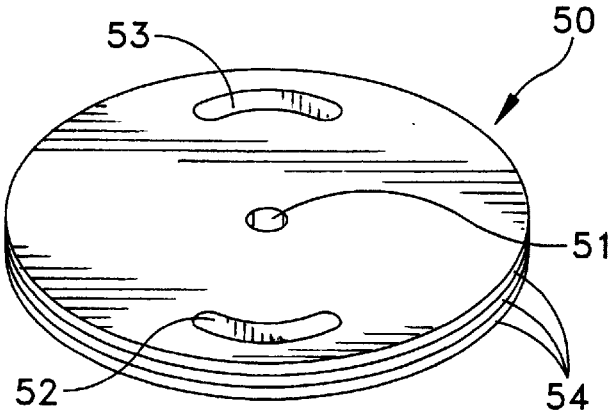

FIG. 3 shows a third embodiment of a basic element according to the invention. The flat basic element 50 in said case is round in shape and composed of three layers 54. Like the basic element 40, the basic element 50 also has two elongate openings 52, 53, which are disposed symmetrically relative to the central opening 51 and to the centre line formed through the latter. The two elongate openings 52, 53 likewise have a curvature which at least partially follows the outer radius of the basic element 50.

Figure 4:
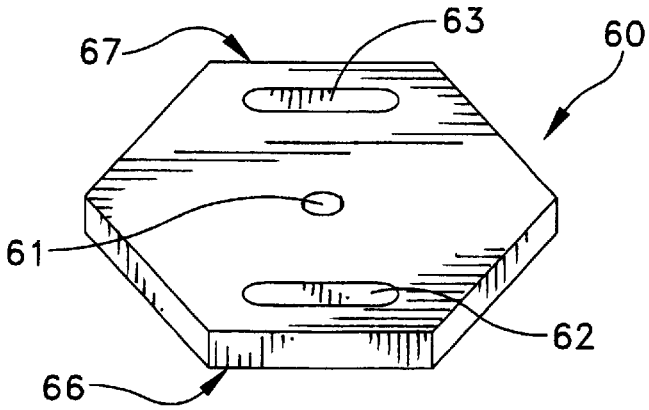

FIG. 4 shows a perspective view of a fourth embodiment of a basic element according to the invention. The basic element 60 also has a central opening 61. The basic element 60 is hexagonal in shape. It, like the basic element 50, has two elongate openings 62, 63. The latter are formed parallel to the outside edges 66, 67 and mirror-symmetrically relative to an imaginary centre line through the central opening 61. Here, the elongate openings 62, 63 take the form of straight openings having in each case rounded corners and no curvature. Naturally they might, like the precedingly described openings, e.g. the elongate openings 52, 53 according to FIG. 3, be provided with a curvature.

Instead of the hexagonal basic element 60 it is however also possible to form a polygon having any desired different number of sides, e.g. an octagon or decagon. Such a polygon then becomes increasingly similar to the round basic element 50 according to FIG. 3. A triangular shape might even be possible, in which case the arrangement of three elongate openings appears practical for gymnastic purposes or alternatively for swimming exercises.

Figure 5:
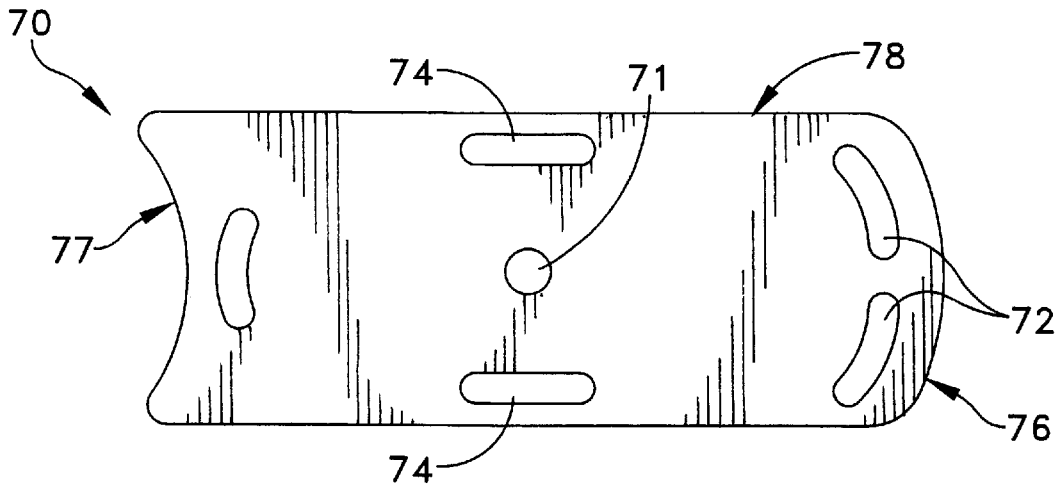

FIG. 5 shows a plan view of a fifth embodiment of a basic element according to the invention. The basic element 70 is substantially rectangular and likewise has a central opening 71. The one outside edge 76 has an outward curve, the other edge 77 an inward curve, as precedingly described with reference to the embodiment according to FIG. 1. Unlike said embodiment, the basic element 70 according to the invention shown in FIG. 5 may be grasped even by a plurality of persons. To said end there are namely five elongate openings 72, 73, 74 provided in the region of the longitudinal edges 78 and the narrow outside edges 76, 77 of the basic element 70. The elongate openings 72 and 73 in the region of the edges 76, 77 are in each case likewise provided with a curvature enabling improved insertion of the hands. The elongate openings 74 in the region of the longitudinal edges 78 are on the other hand straight in shape because the longitudinal edges 78 also extend in a straight manner.

Such a basic element 70 may be grasped either by five persons each using only one hand or by two persons each using both hands and one further person using only one hand. It is also possible to carry out so-called "yo-yo gymnastics". When the basic element 70 is to be grasped by four persons each using both hands, four instead of two openings per longitudinal edge 78 and two instead of one opening in the region of the edge 77 are preferably provided. The basic element also proves advantageous as a swimming board for one person because it is possible to get hold either in the openings 72 or laterally at the openings 74 or with one hand at the openings 77. For gymnastic exercises it is however also possible to insert the thumb or thumbs into the opening 71 and the fingers into the opening(s) 74 or vice versa.

Figure 6:
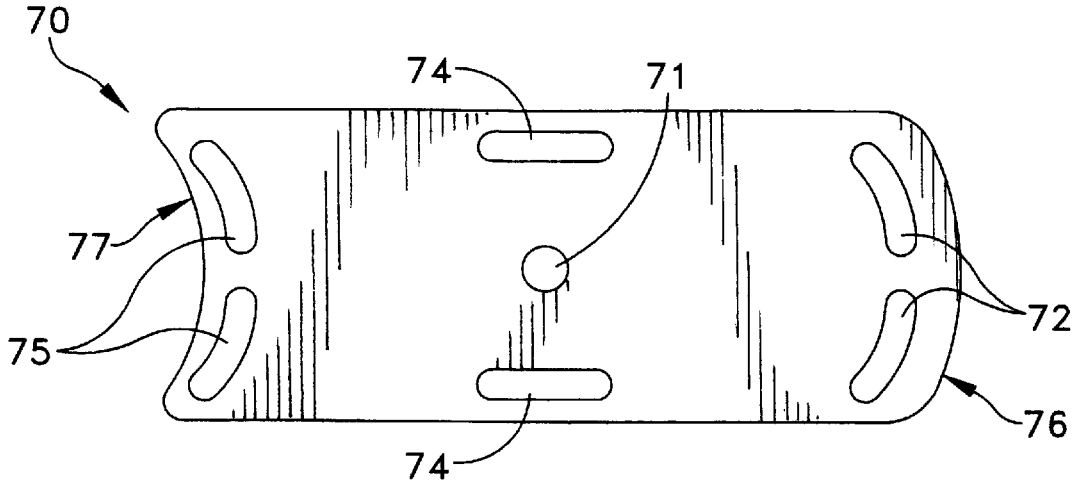

An embodiment of a basic element according to the invention, which may be grasped by three persons each using both hands, is shown in plan view in FIG. 6. The shaping of the basic element corresponds substantially to the shaping according to FIG. 5. Unlike the basic element 70 according to FIG. 5, in the basic element according to FIG. 6 two elongate openings 75 are provided in the region of the edge 77. The elongate openings 75, in terms of their shaping, follow the inward curve of the edge 77.

Figure 7:
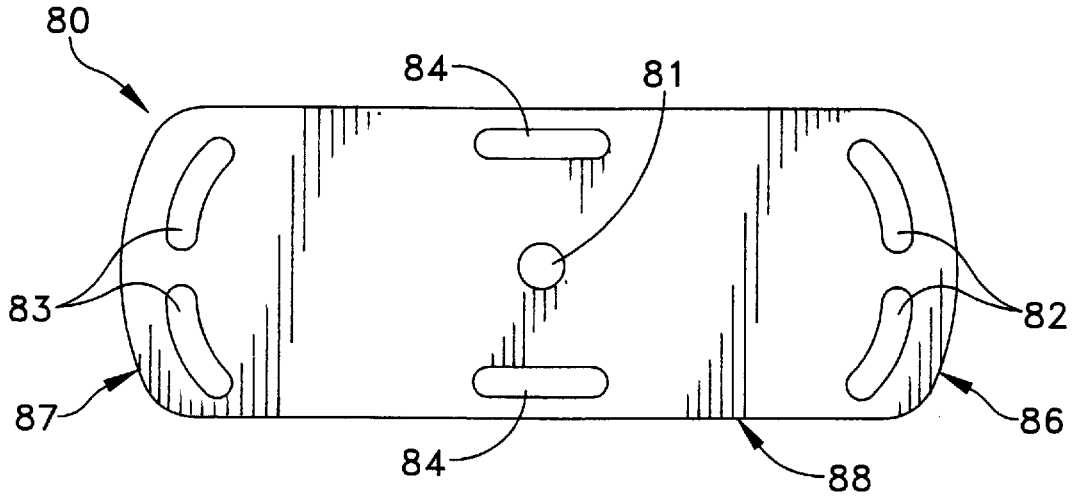

FIG. 7 shows in plan view a further embodiment of a basic element according to the invention. The basic element 80, like the basic element 40 according to FIG. 2, has two outside edges 86, 87 each with an outward curve. Instead of the only one elongate opening per outside edge provided there, in the embodiment according to FIG. 7 two elongate openings are provided in the region of each of the outside edges 86, 87. In terms of their curvature, they each follow the curvature of the outward curves of the two outside edges 86, 87.

In the region of the central opening 81 of the basic element 80, there is provided parallel to each of the two longitudinal edges 88 of the basic element an elongate opening 84.

Like the basic element 70 according to FIG. 6, the basic element 80 according to FIG. 7 may also be grasped either by six persons each using only one hand or by three persons each using both hands or by four persons, wherein in the case of the last variant two persons hold on with both hands and two persons hold on with only one hand to the basic element. Its use as a swimming board for one person in the manner described in FIG. 5 is also possible, as is its use as a gymnastics element in the manner described there.

Figure 8:
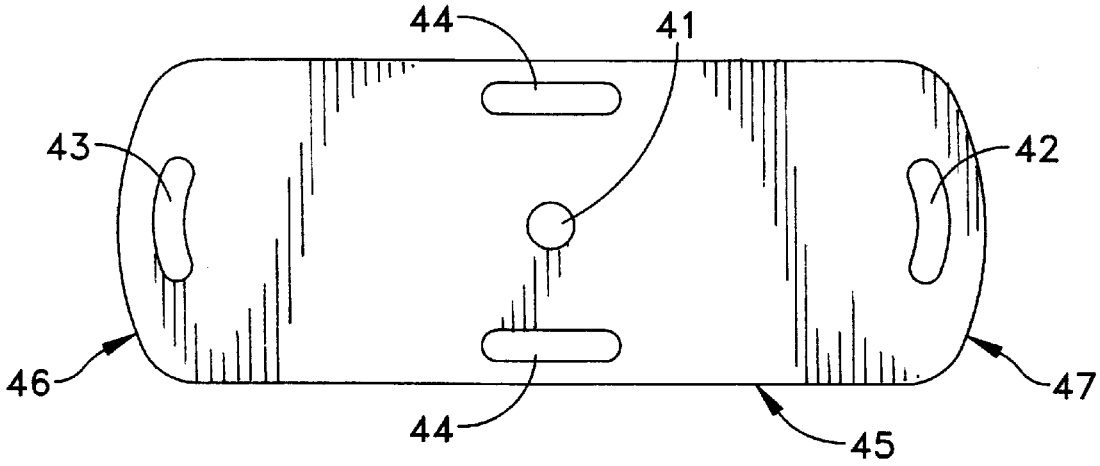

In FIG. 8, a further embodiment of a basic element according to the invention is shown in plan view. The basic element is substantially a combination of the basic element 40 according to FIG. 2 and the basic element 80 according to FIG. 7. It has two outside edges 46, 47, each with an outward curve, and two longitudinal edges 45 which are straight in shape. Around the central opening 41, elongate openings 44 are formed parallel to each of the two longitudinal edges 45.

The embodiment according to FIG. 8 is suitable for use, for example, by four persons each grasping the basic element with only one hand or by two persons each grasping the basic element from diagonally opposite positions. Naturally the basic element may, like the basic elements illustrated in the preceding Figures, also be used by one person only.

Figure 9:
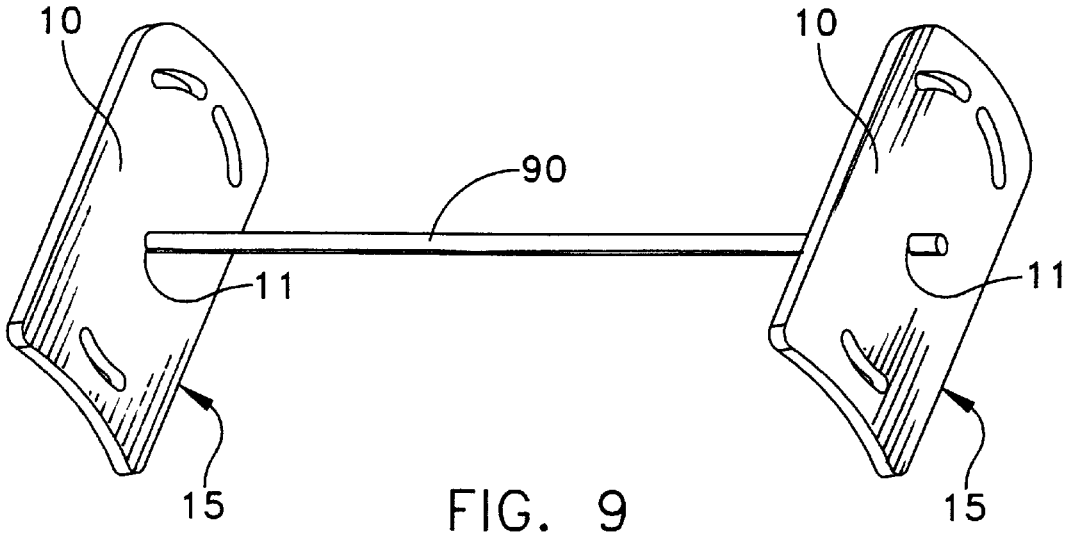

FIG. 9 shows a perspective view of a further embodiment of the system according to the invention for swimming and/or gymnastics applications. In said embodiment, two basic elements 10 are connected to one another by a rod-like additional element 90. To said end, the rod-like element 90 is inserted through the central opening 11 of the respective basic element and pushed far enough through for friction and seizing to provide a slip-proof hold in said opening.

To create maximum friction between the outer surface of the rod-like additional element 90, which is in particular a round rod, and the surface of the central opening 11 of the basic element 10, the rod-like additional element is preferably made of the same material as the basic element. The additional element is therefore made, for example, of a high-expansion foam material, in particular Plastazote®.

An arrangement such as is shown in FIG. 9 may be used as a support for swimming and/or gymnastic exercises in water in the prone and in the supine position. For said purpose, the swimmer, for example, holds onto the additional element with his hands or supports himself by his arms or armpits on said additional element 90. The two basic elements are in said case preferably supported by their longitudinal edges on the surface of the water or are slightly immersed in the water.

The diameters of the central openings of the respective basic element are preferably adapted to the diameter of the rod- like element 90. When a known such rod-like element in the form of a round bar is used, an adaptation to its diameter is preferably effected.

Figure 10:
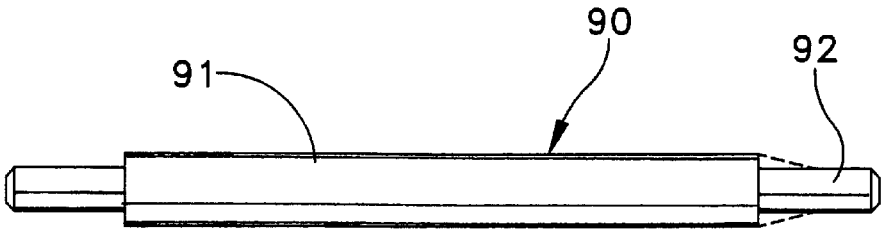

FIG. 10 shows a side view of an embodiment of the rod-like additional element. The latter comprises a substantially uniformly thick middle region 91 and tapered end regions 92. The thicker middle region 91 provides a better supporting surface for the back or chest. The tapered end regions preferably fit into the central openings of the basic elements. Upon loading of the middle region 91, the basic elements are tilted at an angle. The end regions 92 preferentially project beyond the outer surface of the basic elements and, upon tilting of the basic elements, are jammed in the central openings of the latter. They are therefore held fast in said central openings. The transition into the end regions 92 may alternatively be continuous in the manner indicated by dashes.

FIG. 11 shows a second embodiment of the gripping element 30. The latter is angular in cross section. Two board-like parts 36, 37 meet one another substantially at right angles (in the region of the outside edges of their longitudinal sides). The part 36, on its surface directed away from the part 37, is provided with the handles 31. The latter may be glued on there, inserted into openings and fastened therein or, during manufacture of the top surface of the part 36, may be integrally cast or incorporated in some other way there.

The part 37 is used to generate a water resistance. Instead 19 of or in addition to the element 20, a particular difficulty factor may be achieved by providing the gripping element 30 on the basic element 10.

Figure 12:
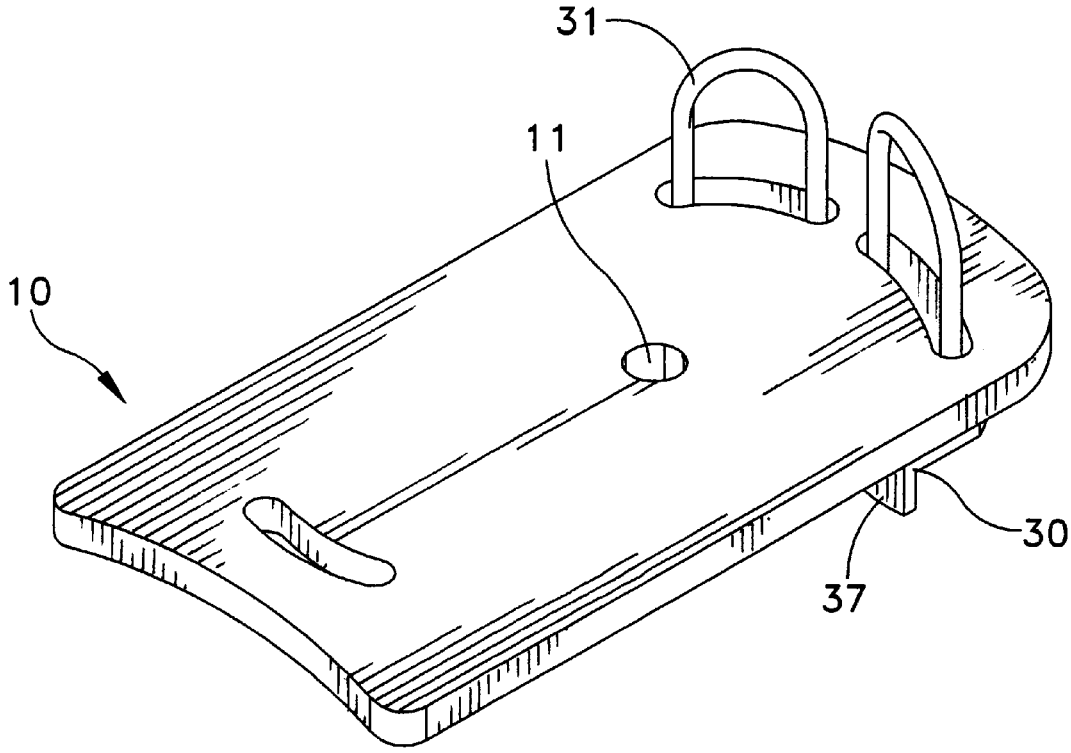
Figure 13:
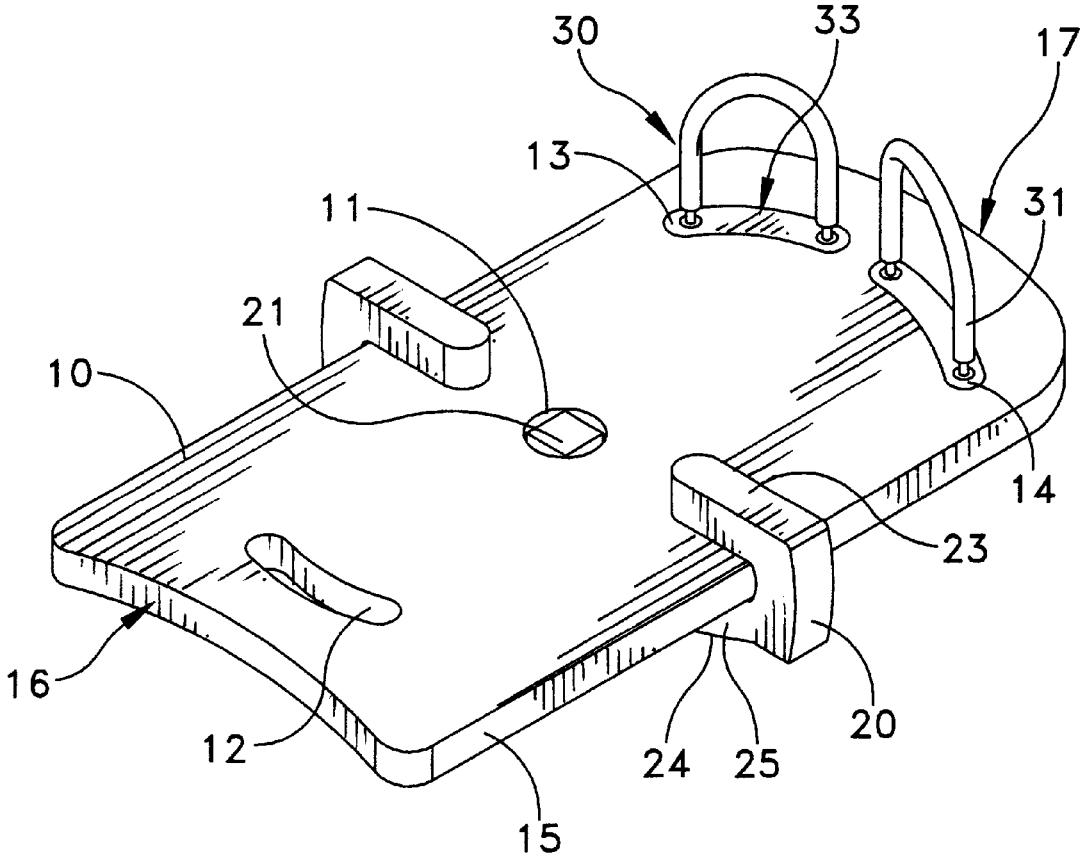

As FIG. 12 more clearly reveals, the handles 31 are again inserted through the elongate holes 14. In addition, the part 36 provided with the handles 31 is positioned against the underside of the basic element 10. The part 37 then projects from said surface and may used as a water resistance-generating element especially when swimming backwards, when the hands are inserted backwards into the handles 31.

The shape of handles 31 and gripping element 30 may be freely selected. The angle between part 36 and part 37 may also be made dependent upon the resistance which is required to be generated in each case.

In FIG. 12 the central opening is disposed, not as with the preceding embodiments in the middle of the basic element, but in the region of the centre line (in longitudinal direction of the basic element), but off-centre. At said point the resistance element 20 might be provided instead of (or in addition to) the gripping element 30. All that is required is for the dimensions of element 20 and basic element 10 to be tuned to one another in terms of the arrangement of opening 11 and projecting lug 21. Instead of only one opening 11 and projecting lug 21, a plurality might be provided alongside one another and adapted to one another.

FIG. 3 shows a perspective view of the basic element 10 according to FIG. 1 with additional elements 20 and 30 attached thereto. Either all of the additional elements are mounted at the same time on the basic element, as shown, or in each case only one of them, possibly then additionally the rod-like additional element 90 according to FIG. 9 or 10, arranged in one or more of the openings 11 to 14.

The additional element 20 is shown with its projecting lug 21 engaging into the central opening 11 of the basic element 10. The underside of the basic element is in said case supported on the straight regions 22 of the additional element 20. The hook-like clamping elements 23 embrace the longitudinal edges 15 of the basic element 10 and are supported by their outer extensions on the top surface of the basic element. A tilting of the additional element during swimming, e.g. with engagement of the hand into the middle elongate opening 12 and adjacent to the outside edge 16 having the inward curve or however, from the other direction, into the elongate openings 13, 14 adjacent to the outside edge 17 having the outward curve, is therefore possible only within small ranges, in particular of 2–3 cm in relation to the bottom edge of the curved end 24. The actual water resistance is generated by the surface 25 of the additional element 20.

For backwards-swimming exercises, the board-like gripping element 30 is fastened to the basic element 10. This is effected by supporting the board part 33 against the underside of the basic element, the handles 31 then being inserted through the elongate openings 13, 14 of the basic element. The swimmer may then grasp said handles 31 with his hands. To do so, he has to stretch the upper part of his body, thereby necessarily achieving an optimum supine position from a swimming technique standpoint. The additional element 20, when simultaneously mounted on the basic element 10, moreover generates a water resistance for practising legwork in particular.

As an alternative thereto, the feet of the swimmer may be inserted through the handles for practising armwork.

The basic elements and additional elements illustrated in the preceding Figures may be of any desired dimensions. For example, different dimensions of basic elements may be provided for children and for adults. In said regard, dimensions of around 500×290 mm for adults and 350×220 mm for children have proved very advantageous. The material thicknesses of the basic elements and additional elements are in said case e.g. 30 to 40 mm, in the case of substantially rectangular basic elements, or 35 to 50 mm, in the case of round or polygonal embodiments. The dimensions of the elongate openings may be, for example, 110×30 mm and the central openings may, for example, have a diameter of e.g. 50 mm. The water resistance-generating additional elements 20 are, for example, 390 mm wide and 180 mm high. The water resistance-generating surface 25 is in said case, for example, between 80 and 200 mm high.

The board part 33 of the board-like gripping element 30 is, for example, cut or punched out of a 3 mm thick plastic board. The loops 35 are made, for example, from 6 mm thick nylon cord, the ends of which are knotted at the underside of the board part. Plastic washers are in said case preferably provided between the knots and the underside of the board part to prevent the knots from sliding through the, for example, 8 mm drill holes in the board part.

The rod-like additional element 90 has a diameter of e.g. 50 mm or, in the case of tapered ends, a diameter in the middle region of around 65 mm and in the end region of e.g. 38 or 48 mm depending on the diameter of the central opening of the respective basic element. The end regions may be e.g. 120 mm long. The total length is e.g. around 1500 mm.

The flat basic elements are dimensioned in each case to suit their intended application so that, for example, a basic element for gymnastic exercises for a plurality of persons (cf. FIGS. 5 to 8) will have larger dimensions than a basic element for only one person such as is illustrated, for example, in FIG. 3 or 4. However, the dimensions of the additional elements, namely the water resistance-generating element 20 and the board-like handle element 30, are also dimensioned to suit the respective intended application and/or in dependence upon the physical size of the user, in the case of the handles in dependence upon the hand size or the span of the feet.

The additional elements 20, 30, given suitably shaped openings and dimensions, may also be fastened to known basic elements so that the advantages of the former may then be turned to good use also with the latter.

List of reference characters

| | |
|---|---|
| 10 | flat basic element |
| 11 | opening, central |
| 12 | elongate opening, middle |
| 13 | elongate opening |
| 14 | elongate opening |
| 15 | longitudinal edge |
| 16 | outside edge (inward curve) |
| 17 | outside edge (outward curve) |
| 18 | corners |
| 19 | corners |
| 20 | water resistance-generating additional element |
| 21 | projecting lug |
| 22 | straight regions |
| 23 | hook-like clamping elements |
| 24 | curved end |
| 25 | surface |
| 30 | board-like gripping element |
| 31 | handles |
| 32 | openings |

-continued

| List of reference characters |
|---|
| 33 board part |
| 34 sheath elements |
| 35 loops |
| 36 part |
| 37 part |
| 40 basic elements |
| 41 central opening |
| 42 elongate opening |
| 43 elongate opening |
| 44 elongate opening (straight) |
| 45 longitudinal edges |
| 46 outside edge (outward curve) |
| 47 outside edge (outward curve) |
| 50 basic element |
| 51 central opening |
| 52 elongate opening |
| 53 elongate opening |
| 54 layers |
| 60 basic element |
| 61 central opening |
| 62 elongate opening |
| 63 elongate opening |
| 66 outside edge |
| 67 outside edge |
| 70 basic element |
| 71 central opening |
| 72 elongate opening |
| 73 elongate opening |
| 74 elongate opening |
| 75 elongate opening |
| 76 outside edge (outward curve) |
| 77 outside edge (inward curve) |
| 78 longitudinal edges |
| 80 basic element |
| 81 central opening |
| 82 elongate opening (curved) |
| 83 elongate opening (curved) |
| 84 elongate opening (straight) |
| 86 outside edge (outward curve) |
| 87 outside edge (outward curve) |
| 88 longitudinal edges |
| 90 rod-like additional element |
| 91 middle region |
| 92 end region |

What is claimed is:

1. A swimming and/or gymnastics system, including a flat basic element having openings and further additional elements connectable to the latter by insertion, characterized in that additional elements are a water resistance-generating additional element, which is shaped so as to be engageable into at least one central opening of the basic element and embraces the basic element in a clamping manner at the latter's outside edges, and a gripping element which engages into elongate openings of the basic element.

2. The system according to claim 1, wherein the additional element is a rod-like element which is connectable to one or more basic elements.

3. The system according to claim 1, wherein the flat basic element has an odd number of elongate openings, in particular three or five elongate openings, and a substantially round central opening.

4. The system according to claim 1, wherein the flat basic element has an even number of elongate openings, in particular two, four or six elongate openings, and a substantially round central opening.

5. The system according to claim 1, wherein the elongate openings are provided with a curvature, which is shaped and dimensioned in accordance with the hand curvature of hands inserted therein.

6. The system according to claim 3, wherein two of the three elongate openings are disposed alongside one another in the region of an outside edge of the basic element so as to describe an arc and the one opening is disposed, mid-way between said other two openings and in alignment with the central opening, in the region of the opposite outside edge.

7. The system according to claim 6, wherein the outside edges of the basic element describe, at the end having the one middle elongate opening, an inward curve and, at the opposite end having the two openings, an outward curve.

8. The system according to claim 1, wherein the flat basic element is elongate in shape, and include corners which are rounded off.

9. The system according to claim 4, wherein at least two of the elongate openings are provided substantially mirror-symmetrically relative to one another and opposite one another in the region of longitudinal edges of the basic element.

10. The system according to claim 1, wherein the flat basic element is elongate in shape, having narrow outside edges each describing an outward curve or having narrow outside edges (16, 17; 76, 77) describing an outward curve and an inward curve and having straight longitudinal edges.

11. The system according to claim 1, wherein the flat basic element is round or polygonal, in particular hexagonal or octagonal in shape.

12. The system according to claim 2, wherein the central opening of the flat basic element is substantially round and has a diameter adapted to the diameter of the rod-like additional element.

13. The system according to claim 1, wherein the water resistance-generating additional element is formed in a mirror-symmetrical manner and provided with a middle projecting lug, which is engageable into the central opening of the flat basic element and next to which are provided substantially straight regions adjoined on either side by clamping elements, which are directed in a hook-like manner towards the projecting lug.

14. The system according to claim 1, wherein the gripping element comprises a substantially flat board part having handles.

15. The system according to claim 14, wherein the board part is shaped like a boomerang and provided with openings, into which the handles engage and/or are fastened therein.

16. The system according to claim 14, wherein a resistance part is fastened or connected to the board part at an angle to the latter.

17. The system according to claim 16, wherein the board part is shaped like a boomerang and provided with openings, into which the handles engage and/or are fastened therein.

18. The system according to claim 15, wherein a resistance part is fastened or connected to the board part at an angle to the latter.

19. The system according to claim 15, wherein the board part is shaped like a boomerang and provided with openings, into which the handles engage and/or are fastened therein.

* * * * *

UNITED STATES PATENT AND TRADEMARK OFFICE

CERTIFICATE OF CORRECTION

PATENT NO : 6,142,843

DATED : November 7, 2000

INVENTOR(S) : Otto Haase

It is certified that error appears in the above-identified patent and that said Letters Patent are hereby corrected as shown below:

On title page, item 73 Assignee:
replace "iBrigette Haase"
with --Brigitte Haase--.

On title page, item 73 Assignee:
replace "United Kingdom"
with --Germany--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*